United States Patent [19]

Dineen

[11] 4,372,116

[45] Feb. 8, 1983

[54] STIRLING ENGINE CONTROL MECHANISM AND METHOD

[75] Inventor: John J. Dineen, Durham, N.H.

[73] Assignee: Mechanical Technology Incorporated, Latham, N.Y.

[21] Appl. No.: 228,457

[22] Filed: Jan. 26, 1981

[51] Int. Cl.[3] ..... F02G 1/06

[52] U.S. Cl. ..... 60/525; 60/517; 74/60; 91/506; 92/13.1

[58] Field of Search ..... 60/517, 525, 526; 74/60; 91/506; 417/222; 92/13.1

[56] References Cited

U.S. PATENT DOCUMENTS

| | | | |
|---|---|---|---|
| 2,396,410 | 3/1946 | Blum | 74/60 |
| 4,030,404 | 6/1977 | Meijer | 91/506 X |
| 4,107,925 | 8/1978 | Watson | 60/521 |
| 4,145,887 | 3/1979 | Meijer | 60/517 |
| 4,152,945 | 5/1979 | Kemper | 74/60 X |
| 4,166,398 | 9/1979 | Girodin | 74/60 |
| 4,174,191 | 11/1979 | Roberts | 417/222 |
| 4,174,684 | 11/1979 | Roseby et al. | 123/48 B |
| 4,258,590 | 3/1981 | Meijer et al. | 91/506 X |

OTHER PUBLICATIONS

*Conceptual Design of a Variable Displacement Engine for Automotive Purposes*, R. J. Meijer and A. P. J. Michels, Proceedings of the I.E.C.E.C. of Apr. 19, 1978, pp. 1834–1840.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A reciprocating-to-rotating motion conversion and power control device for a Stirling engine includes a hub mounted on an offset portion of the output shaft for rotation relative to the shaft and for sliding motion therealong which causes the hub to tilt relative to the axis of rotation of the shaft. This changes the angle of inclination of the hub relative to the shaft axis and changes the axial stroke of a set of arms connected to the hub and nutating therewith. A hydraulic actuating mechanism is connected to the hub for moving its axial position along the shaft. A balancing wheel is linked to the hub and changes its angle of inclination as the angle of inclination of the hub changes to maintain the mechanism in perfect balance throughout its range of motion.

20 Claims, 5 Drawing Figures

STIRLING ENGINE CONTROL MECHANISM AND METHOD

The Government of the United States of America has rights to this invention pursuant to Contract No. DEN3-32 awarded by the United States Department of Energy.

BACKGROUND OF THE INVENTION

The high efficiency potential of the Stirling cycle engine has excited considerable interest since the cost and the availability of petroleum fuels has become a more widely recognized problem. The Stirling engine is an attractive approach to this problem because it has the potential for operating more efficiently and reliably than any other heat engine known today, and it is externally heated so it can be powered by virtually any heat source.

Development of the Stirling engine has uncovered some serious problems. Some of these problems are so serious and seemingly insoluable that Stirling engine development work has been abandoned altogether by certain resourceful and innovative organizations. Two persistent problems encountered by Stirling developers are engine power control and the reciprocating-to-rotating motion conversion mechanisms.

Of the control systems which have been tried heretofore, perhaps the most successful is the working gas mean pressure control (MPC) which adjusts the power level of the Stirling engine by changing the pressure of the working gas charge in the engine. The MPC system uses a high pressure working gas storage vessel which provides a gas charging source to the engine, and a gas compressor driven by the engine for compressing working gas in the storage vessel. The suction inlet of the compressor provides a low pressure dump for reduction of the engine gas charge, and a valve between the engine and the pressure vessel can be opened to increase the working gas pressure.

The MPC technique is effective to control engine power, but certain difficulties have been encountered in its practical application. For example, it was found that a large negative torque can be momentarily generated at the start of charging, which is highly objectionable. To overcome this problem, the working gas is admitted into the engine working space at certain portions of the Stirling cycle, thereby removing the negative torque difficulty. However, the timing and valving mechanism required to achieve this precisely timed admission of working gas into the working space have increased the complexity and cost of the control mechanism and decreased its reliability.

Another control technique which has been considered is the dead volume control. Engine power can be lowered by selectively connecting the engine working space to empty vessels of various volumes to increase the dead volume, that is, the volume in the engine working space not swept by the piston or the displacer. This technique does indeed control the engine power, however, it also reduces engine efficiency and changes engine power in discrete torque steps. In addition, the bulk of the resulting engine is increased and the cost increased proportionately.

Phase control is an effective power control technique for displacer engines, however the Siemens or double acting engine has a power piston which also functions as the displacer, so the piston phase is fixed and cannot be varied.

Stroke control has been used on free-piston Stirling engines to control power output. Indeed, stroke control in these engines is a naturally occurring condition wherein load resistance to the piston motion decreases the piston stroke, but increases the force exerted by the piston. Another control technique using stroke variation is in Stirling engines having a displacer and a piston. By controlling the displacer stroke, the mass flow of gas in and out of the hot and cold space can be reduced so that the range of cyclic pressure amplitude is reduced. However, it is likely that the power control achieved by this technique is a function of the displacer to piston swept volume ratio.

The other serious problem encountered by Stirling engine developers has been the reciprocating-to-rotating motion conversion mechanism. The three mechanisms most intensively addressed by workers in the art have been the crankshaft and connecting rod mechanism most commonly used in internal combustion engines, the rhombic drive mechanism, and the swashplate and the wobble plate drive mechanism. These devices are all heavy, bulky, and expensive. The latter two mechanisms require special, custom built bearings with asymmetrical loads and plane bearing surface which are expensive and require high idle speeds to maintain their bearing capacity. In addition, the crank and swashplate or wobble plate mechanism exert a side load on the piston rod which exacerbates the difficulty of sealing the working gas within a working space of the engine. Attempts to decrease the cost, bulk and side loads exerted by these mechanisms have caused increases in the noise, inefficiency, and unreliability of the mechanisms.

Accordingly, a major advance towards the introduction of a commercial Stirling engine would be made by the provision of a simple and reliable mechanism which provided both power control and reciprocating-to-rotating motion conversion in a small, quiet, and light-weight mechanism that was efficient and reliable.

SUMMARY OF THE INVENTION

Accordingly, it is an object to provide a reliable and fast-acting power control mechanism for a Stirling engine. Another object of this invention is to provide a reciprocating-to-rotary motion conversion mechanism that is small, inexpensive, light-weight, quiet, and efficient. Yet another object of this invention is to provide a combined power control and reciprocating-to-rotary motion conversion mechanism in a single unit.

These and other objects of the invention are attained in a mechanism including an offset portion of the output shaft which extends at an angle to the shaft axis. A hub is mounted on the offset portion for rotation relative thereto and for sliding motion therealong which causes the hub to tilt relative to the axis of rotation of the shaft thereby changing the angle of inclination of the hub to the shaft axis and changing the axial stroke of a set of arms connected to the hub and nutating therewith. A simple, reliable, and fast-acting hydraulic actuating mechanism is connected to the hub for moving its axial position along the shaft. A balancing wheel is linked to the hub and changes its angle of inclination as the angle of inclination of the hub changes to maintain the mechanism in perfect balance through out its range of motion.

DESCRIPTION OF THE DRAWINGS

The invention and its many attendant objects and advantages will become clearer upon reading the following specification in conjunction with the drawings, wherein.

DESCRIPTION OF THE PREFERRED EMBODIMENT

Figure 1:
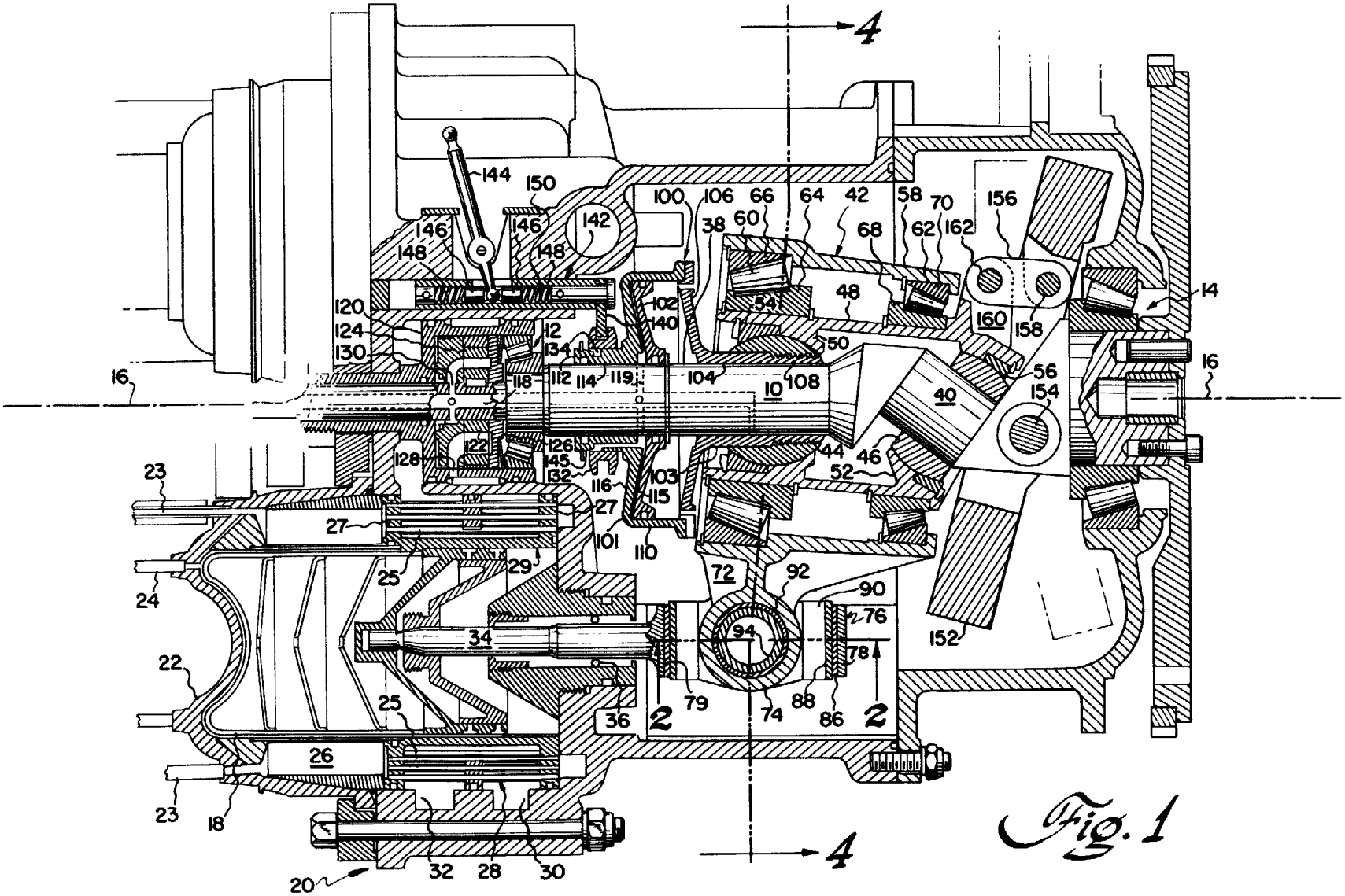
FIG. 1 is a sectional elevation of a mechanism according to the invention.

Turning now to the drawings, wherein like reference characters identify identical or corresponding parts, and in particular to FIG. 1 thereof, a power control and reciprocating-to-rotating motion conversion mechanism is shown mounted on a power output shaft 10 which is journaled on front 12 and rear bearings 14 for rotation about an axis of rotation 16. The mechanism is mounted in the lower or rear end of the crankcase of a Stirling engine whose front or top end includes a set of pistons 18 operating in a working space defined within an engine block 20. The engine block includes a heater head 22 to which is connected to one end of a set of heater tubes 24 that are heated by a combustor (not shown). The other ends 23 of the heater tubes 24 are connected to a regenerator 26 which is an annular structure of fine high temperature wires of high heat capacity. The rear end of the regenerator 26 communicates with a cooler 28 which is a matrix of fine tubes 25 connected at their ends to the end flanges 27 of a cooler body 29. A cooling water inlet 30 and an outlet 32 permit circulation of cooling water through the cooler to cool the gas flowing through the cooler tubes.

The reciprocating motion of the piston 18 causes gas to be circulated cyclically through the heater tubes 24 to the regenerator 26, and the cooler 28 which produces a periodic pressure wave in the working gas in the engine which powers the reciprocating motion of the pistons. The reciprocating motion is transmitted from the pistons through a piston rod 34 to the reciprocating-to-rotating motion converter. The working gas in the engine working space is under high pressure and therefore a seal 36 is necessary to prevent loss of the working gas around the piston rod. It is important that the side loads exerted on the seal 36 by the piston rod be as small as possible. Side loads cause rapid deterioration of the effectiveness of the seal and also increase the friction or dragging force by the seal on the piston rod 34. The mechanism of this invention reduces the side loads exerted on the piston rod 34 to negligible proportions.

The shaft 10 between the bearings 12 and 14, includes a straight portion 38 which lies on the axis of rotation 16, and an offset or eccentric portion 40 whose axis lies at an angle inclined with respect to the axis of rotation 16 of the shaft 10. The offset or eccentric portion 40 has an axial gradient of eccentricity, that is, the eccentricity of the portion 40 of the shaft varies in a regular way along the shaft axially. In particular, the eccentricity, of the portion 40 is a linear function of its axial position along the shaft. In the disclosed embodiment, the axis of the offset portion 40 of the shaft is inclined about 38° with respect to the axis of rotation 16 of the shaft 10. This angle is found to be optimum for a four cylinder, double-acting, Siemens engine of 104 cc displacement in each cylinder and about 87 horsepower.

A hub 42 is mounted on the shaft 10 for rotation relative thereto and for axial translation therealong. The hub 42 includes a front spherical bearing 44 and a rear spherical bearing 46 mounted on said shaft for axial movement therealong. The front spherical bearing 44 is indirectly mounted on the straight portion 38 of the shaft 10 and rear spherical bearing 46 is mounted directly on the offset portion 40 of the shaft 10. Thus, when the spherical bearings 44 and 46 move along the shaft, the front spherical bearing 44 moves parallel to the shaft axis 16 and the rear spherical bearing 46 moves at an angle to the shaft axis 16 causing the hub 42 to tilt with respect to the axis 16.

The hub 42 includes an inner cylinder 48 having a front inner bearing shoe 50 tiltably mounted on the front spherical bearing 44. The inner cylinder 48 also includes a rear inner bearing shoe 52 tiltably mounted on the rear spherical bearing 46. Front and rear bearing segments 54 and 56, respectively, are secured to the inner cylinder 48 adjacent the front and rear inner bearing shoes 50 and 52, respectively, to hold the inner cylinder 48 on the spherical bearings 44 and 46 when they are moved axially along the shaft 10.

An outer cylinder 58 is journaled to the inner cylinder 48 for rotation relative thereto and axial translation therewith. Front and rear tapered roller bearings 60 and 62, respectively, travel in inner and outer races 64, 66, 68, and 70 to provide rotational support for the non-rotating outer cylinder 58 relative to the rotating inner cylinder 48, and provide axial force transmission between the two cylinders by virtue of the inclined orientation of the tapered roller bearing elements 60 and 62.

Figure 2:
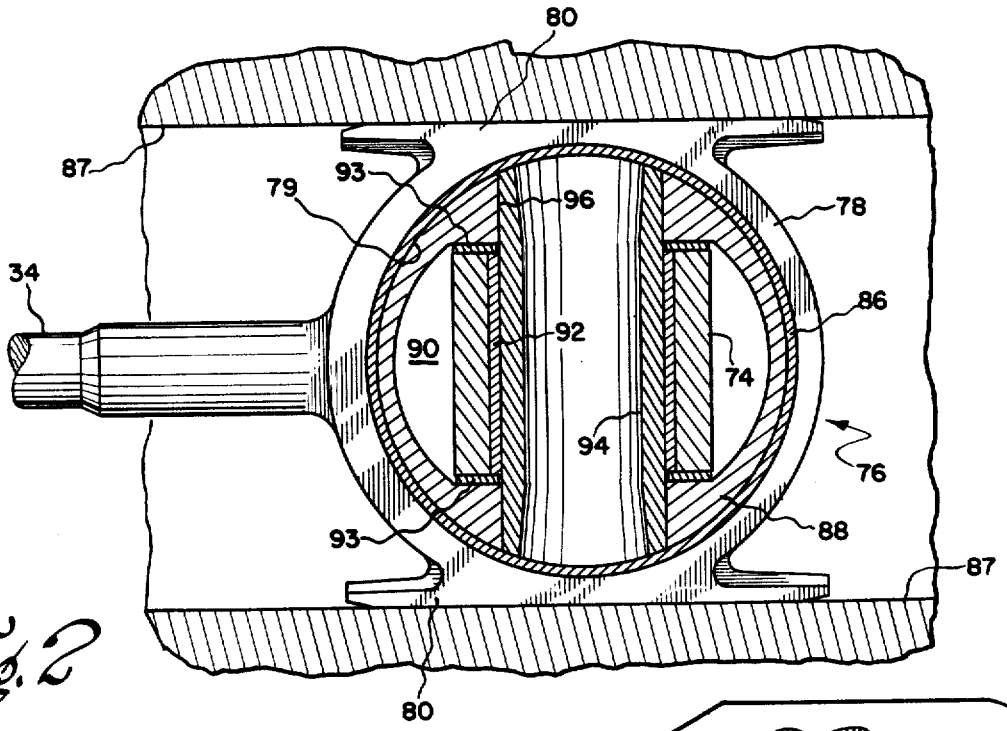
FIG. 2 is a sectional plan along lines 2—2 in FIG. 1.
Figure 3:
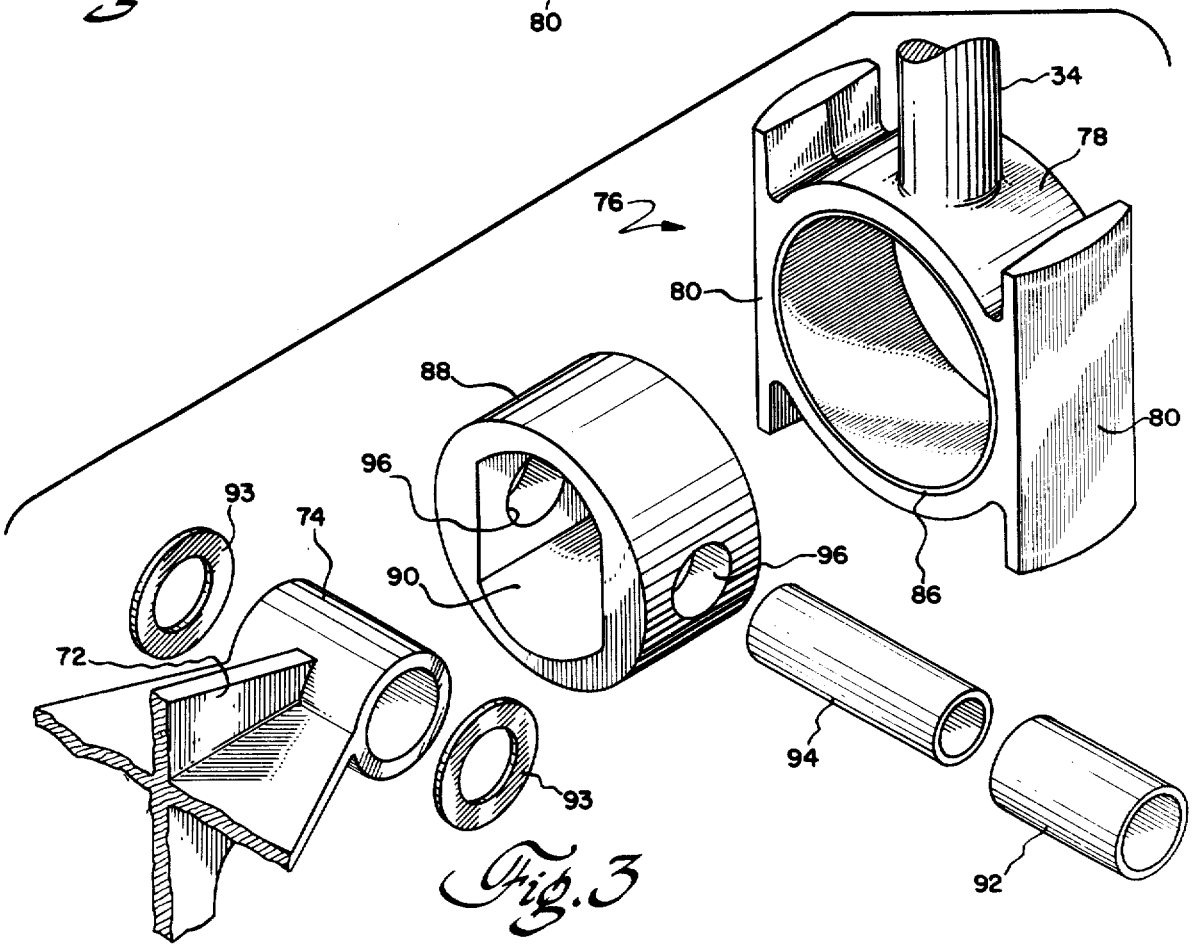
FIG. 3 is an exploded view of the socket connection between the piston rod cross head and the hub boss.
Figure 4:
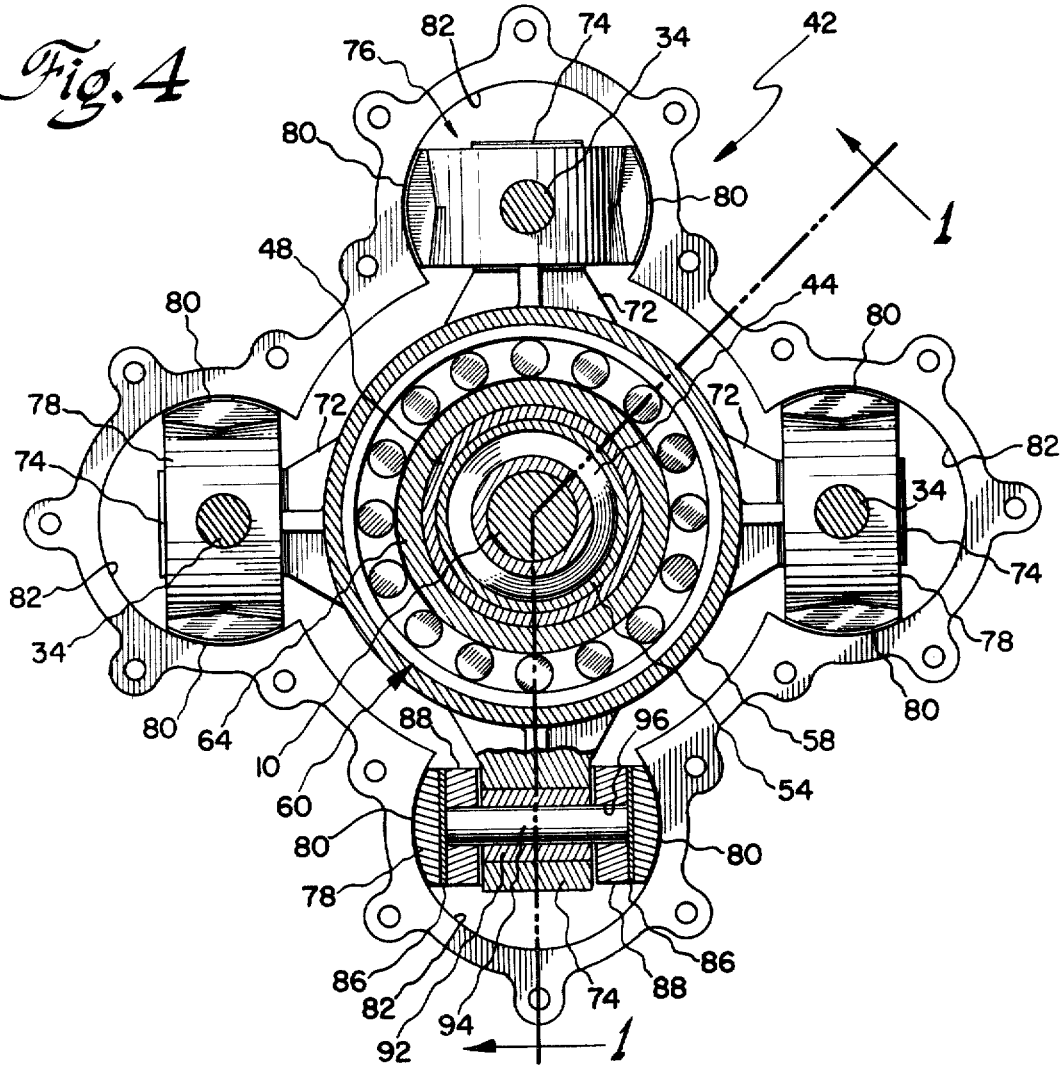
FIG. 4 is an end elevation along lines 4—4 in FIG. 2.

The outer cylinder 58 has formed thereon four radially extending arms 72 (only one of which is shown in FIG. 1), each of which terminates in a cylindrical boss 74. The reciprocating motion of the piston 18 is transmitted to the cylindrical boss 74 and thence through the arm 72 to the outer cylinder 58 which nutates and drives the inner cylinder 48 to rotate the shaft 10 to produce rotary output. The nutating motion of the outer cylinder 58 results in arcuate movement of the arm 72 and boss 74, which movement has a small lateral component. Likewise, the nutating motion of the outer cylinder 58 also causes reciprocating rotational motion about an axis perpendicular to and intersecting the shaft axis 16. Both these rotating and lateral motions must be accommodated by the connection mechanism between the arm 72 and the piston rod 34 to prevent lateral and twisting forces on the piston rod 34. These lateral and rotational motions are accommodated by a universal connector best shown in FIGS. 2 and 3. The connector includes a crosshead 76 connected to the end of the piston rod 34. The cross head 76 includes a ring 78 having a radially extending cylindrical bore 79 therethrough and, a slipper 80 formed on each of two opposite lateral sides of the ring 78. The slipper 80 runs in a cylindrical channel 82 formed in the crankcase for the purpose of absorbing the reaction torque from the shaft. A low friction bearing surface is applied to the cylindrical channel 82 to reduce the friction between the slippers 80 and the channel 82.

The bore 79 of the crosshead ring 78 is lined with a bearing sleeve 86 for low friction support of a cylindrical socket 88 rotatable and radially slidable in the bearing sleeve 86. The socket 88 has formed therein an elongated opening 90 which extends completely therethrough for receiving the cylindrical boss 74. The cylindrical boss 74 is lined with a bearing bushing 92 and receives a piston pin 94 which extends completely through the boss 74 and into a cylindrical hole 96 formed laterally through the socket 88.

In operation, the piston 18 drives the piston rod 34 on a power stroke toward the rear of the engine and is driven on a compression stroke toward the front of the engine by the motion conversion mechanism of this invention. As the piston rod 34 moves on a straight linear path toward the rear, the crosshead 76 is guided in a straight linear path toward the rear by the slippers 80 travelling in the cylindrical channel 82. The slight lateral movement of the cylindrical boss on the end of arm 72 as it follows its arcuate path is accommodated by the lateral movement (seen as vertical in FIG. 1) of the socket 88 sliding in the bore of the crosshead 76. The twisting motion of the arm 72 as it follows the nutating outer cylinder 58 is accommodated by the socket 88 rotating about its axis in the bore of the crosshead 76. The rocking motion of the arm 72 about an axis perpendicular to the plane of FIG. 1 is accommodated by the rotation of the boss 74 about the bearing bushing 92 on the pin 94. Thus the twisting and lateral forces exerted by the nutating hub 42 are entirely isolated from the piston rod 34.

STROKE CONTROL

Stroke control is achieved in this invention by moving one end of the hub 42 along the straight portion 38 of the shaft 10, and moving the rear end of hub 42 along the offset portion 40 of the shaft 10 so that the angle of inclination of the hub with respect to the shaft axis 16 can be controlled by the axial position of the hub along the shaft 10.

In this embodiment, the axial movement of the hub 42 is accomplished hydraulically. A hydraulic cylinder 100 is slidably mounted on the straight portion 38 of the shaft 10 and rotates with it. A piston 102 is fixedly mounted on the straight portion 38 of the shaft 10 within the movable hydraulic cylinder 100 and forms a reaction surface for the hydraulic fluid admitted under pressure into the hydraulic cylinder 100.

The hydraulic cylinder 100 is made of a front member 101 and a rear member 103. The rear member includes a cylindrical body 104 and a flared flange 106. The rear end of the cylindrical body 104 is externally threaded at 108 and engages an internally threaded bore of the front spherical bearing 44. In this way, the spherical bearing 44 is rigidly attached to the hydraulic cylinder 100 and moves with it. The front member 101 of the hydraulic cylinder 100 includes a large diameter cylindrical portion 110 whose inner cylindrical surface forms a sliding hydraulic seal with the outer peripheral edge of the hydraulic piston 102. A forward cylindrical portion 112 of the front member 101 has a bore 114 which fits snuggly on the straight portion 38 of the shaft 10. A web portion 116 joins the forward cylindrical portion 112 with the outer cylindrical portion 110. The hydraulic cylinder 100 is thus a cylinder fitting closely on the straight portion 38 of the shaft 10 at both its front and rear ends, and has an enlarged center portion which receives and coacts with the hydraulic piston 102.

A hydraulic chamber 115 between the front face of the piston 102 and the inside face of the web 116 is pressurized through an axial oil passage 118 and a connecting radial oil passage 119 through the shaft 10 by means of an oil pump 120. The large axially facing surface areas of the relatively moving surfaces of the hydraulic chamber 115, viz. the inside adjacent surfaces of the web 116 and the piston 102, enable the use of low hydraulic pressure in the hub inclination control system. The oil pump 120 is a gear pump having a gear 122 travelling around an internally geared passage 124 having a slightly different pitch on the inside surface of the pump body 126. The pump draws oil into the pump body 126 through a suction port 128 which communicates via oil passages (not shown) with an oil sump in the crankcase. Oil under pressure is expelled out of the pump body 126 through a pressure exhaust port 130 and into the oil passage 118. The oil pump 120 also supplies oil to the bearings 44 and 46 through suitable oil passages, therefore the pump 120 serves a dual purpose. For this reason, the pump is designed with excess capacity so that, at low engine speeds, it will provide a sufficient pressure head to supply oil to the bearings as well as pressurize the hydraulic chamber 115.

The inclination control for the hub 42 is achieved by use of a control spool 132 axially slidable on the forward cylindrical portion 112 and acting in conjunction with an oil outlet groove 134. The axial position of the spool 132 on the forward cylindrical portion 112 is controlled by a bifurcated control arm 140 mounted on the end of an axially movable control rod 142. The axial position of the control rod 142 is set by a pivoted control lever 144.

In operation, assume that the hub 42 is in the position of maximum tilt as shown in FIG. 1, and that it is desired to decrease the angle of the tilt to decrease the engine power. The operator moves the control lever 144 through a suitable linkage from his control position to move the control rod 142 to some position forward of the position shown. This action causes the bifurcated control arm 140 to move the control spool 132 forwardly on the forward cylindrical portion 112 of the hydraulic cylinder 100, thereby sealing the oil outlet groove 134 and preventing leakage therefrom. The oil pump 120 now having no leakage path for oil output, begins to pressurize the hydraulic chamber 115 through the oil passages 118 and 119. As the hydraulic chamber pressure rises, the hydraulic cylinder 100 moves forwardly along the shaft 10 and draws the front end of the hub 42 with it. The front end of the hub 42 moves axially along the straight portion 38 of the shaft, and the rear portion of the hub 42 travels along the offset portion 40 of the shaft at an angle to the straight portion 38, thereby decreasing the angle of inclination of the hub 42. When the hydraulic cylinder 100 reaches the position set for the control spool 132, the front edge of the oil groove 134, which is chamfered at 145, begins to clear the front edge of the spool 132 and provide a leakage path from the hydraulic chamber 115. Thus, at some very precise point, the oil pressure force in the hydraulic chamber just matches the mean rearward force exerted by the piston rods 34 on the hub mechanism so that the hub angle of inclination remains constant. Since the mechanism follows the control spool 132, the system is self correcting, so there is no need for a position sensing mechanism and a feedback system.

The actual range of motion of the control spool 132 on the forward cylindrical portion 112 of the hydraulic cylinder 100 is very short because the effective control stroke of the control spool 132 need be only long enough to cover and uncover the oil groove 134. Therefore, a centering mechanism is used on the control rod 142 including a travelling slug 146 engaged with a lower end of the control lever 144 on both front and rear sides thereof, and a centering spring 148 engaged between the travelling slug 146 and the ends of the control cavity 150 in which the travelling slug 146 moves.

In operation, when the control lever 144 is moved, for example to the full extremity of its stroke, the control rod 142 moves bodily until the control spool 132 reaches the limit of its stroke against the web 116 or against a snap ring on the front end of the forward cylindrical portion 112 of the hydraulic cylinder front member 101. Continued movement of the control lever 144 causes the centering spring to be compressed at one end and expanded at the other end as the travelling slug 146 moves in the control cavity 150 in the control rod 142. As the hydraulic cylinder 100 moves forwardly or rearwardly under the pressurization or draining of the hydraulic chamber 115, the control spool 132 will travel with the hydraulic cylinder 100 in its position against the stop until the travelling slug 146 reaches the center position in the control cavity 150. The centering springs 148 now become ineffective to move the control rod 142 and the control spool 132 now holds its position as the hydraulic cylinder 100 moves relative to the control spool to open the oil groove 134, whereupon the axial movement of the hydraulic cylinder will cease.

Figure 5:
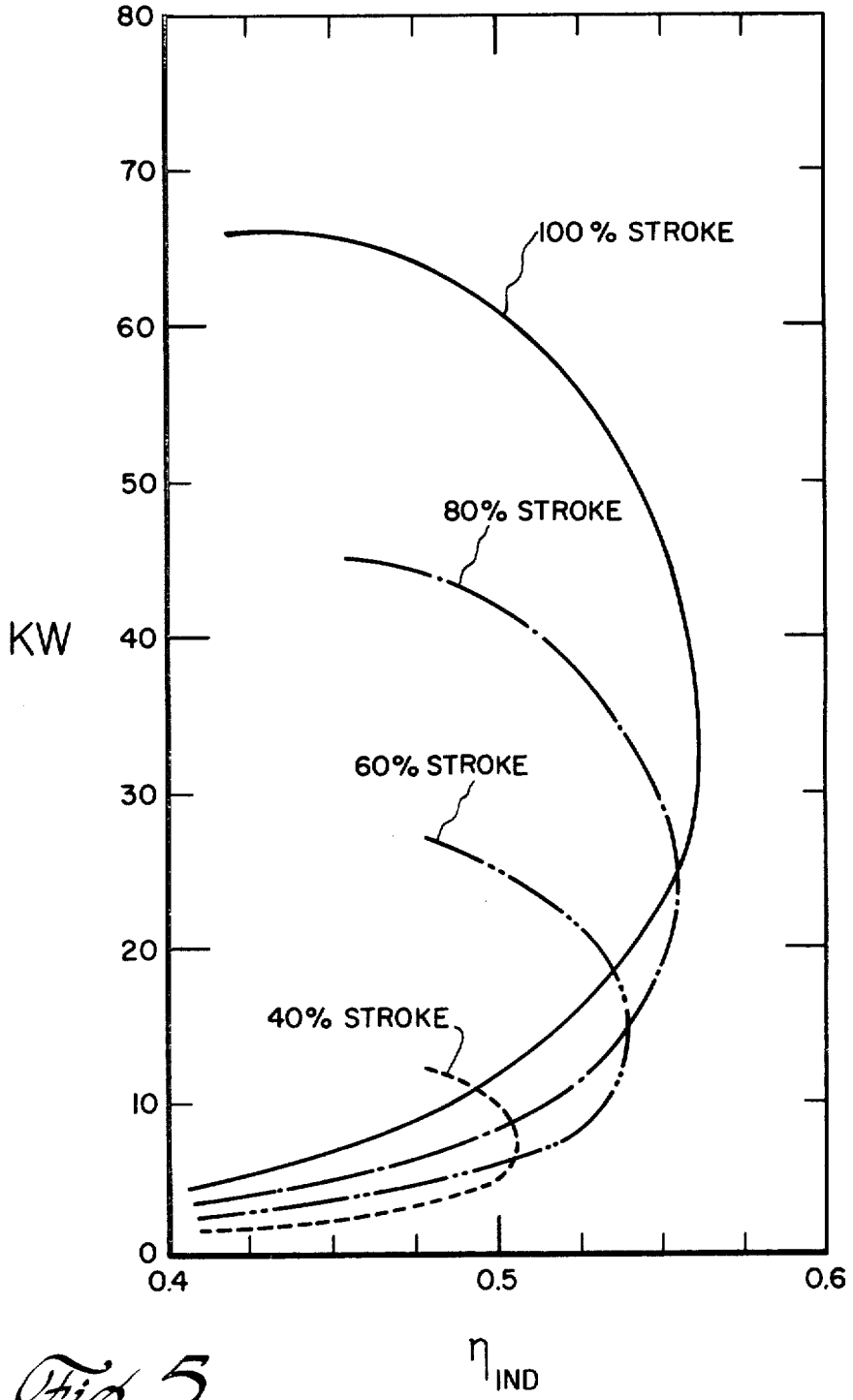
FIG. 5 is a graph showing power versus stroke in a Stirling engine controlled by the mechanism of FIG. 1.

The efficiency of the engine with the stroke modulation power control remains high at most power levels. The engine map shown in FIG. 5 shows that the engine can be operated in a range of indicated efficiency of about 52–54% over a range of output power levels of 10–55 kw. This covers the overwhelming majority of automotive engine operation power requirements. Two aspects of the engine control system that are believed to contribute to this high efficiency over the wide range of engine operation are the reduced working gas pumping loss and piston rod seal friction loss at low stroke and the reduction of the working gas mean pressure and pressure swing that results from a shorter stroke and displacement of the mean piston position into the expansion space or hot end of the cylinder at low stroke.

THE BALANCING MECHANISM

A balancing wheel 152 is pivotally connected to the shaft 10 by a pivot pin 154 which lies offset from the axis of rotation 16 of the shaft 10 and offset from the plane lying parallel to the plane of the wheel and through its center of mass. Thus, the angle of tilt of the balancing wheel 152 relative to the axis of rotation 16 of the shaft 10 controls the eccentricity of the center of mass of the balancing wheel 152 with respect to the axis of rotation 16 of the shaft 10 and also the magnitude of the torque exerted by the rotating mass couple represented by the portion of the balancing wheel above the horizontal plane through the axis of rotation 16 of the shaft 10 and to the rear of the vertical plane through the center of mass of the balancing wheel, and the other portion of the balancing wheel on the other side of said planes. These two balancing aspects are designed to cancel out entirely the corresponding unbalance of the shaft 10 contributed by the eccentricity of the hub 42 and the offset portion 40 of the shaft 10, and the unbalanced couple exerted by the axially reciprocating masses in the engine, such as the piston, piston rod, crosshead, etc. The magnitude of the mass eccentricity and the force couple exerted by the tilted balancing wheel 152 on the shaft 10 is determined by the angle of tilt of the balancing wheel about its pivot pin 154. This angle of tilt is controlled by a link 156 which is pinned to the balancing wheel by a pin 158 and is pinned to a pair of projecting ears 160 on the inner cylinder 48 of the hub 42 by a pin 162. As the hub 42 moves axially, the link 156 swings the balancing wheel 152 about its pivot pin 154 so that each position of the hub 42 has a corresponding unique eccentricity with respect to the axis 16 and angle of tilt of the balancing wheel 152. The tilt of the balance wheel 152 causes a rotating couple to be exerted on the shaft 10 which neatly balances the rotating couple exerted by the axially reciprocating masses. The speed of rotation of the two couples is exactly equal because both are determined by the shaft speed, and the magnitude of the two couples is maintained precisely equal because the piston stroke determines the magnitude of the couple exerted by the reciprocating masses, and the piston stroke is itself determined by the angle of the hub 42 which, through the link 156, determines the angle of tilt of the balancing wheel 152. In this way, it is possible to cancel out entirely the force couple exerted by the eccentric mass of the hub and offset portion 40 of the shaft 10 with respect to the axis of rotation 16, and the force couple exerted by the axially reciprocating masses in the engine.

The invention thus achieves its objects in a simple, reliable and inexpensive mechanism. It has few crank bearings, and a consequent elimination of their cost and unreliability. It has no gears and hence no noise from gear backlash, and none of the wear and mechanical losses which gears introduce. The side load on the piston rod 34 is virtually eliminated, which eliminates the main cause of piston rod seal leakage and a principal cause of power loss dissipated inside the piston rod seal. The mechanism is compact, light-weight, and low in cost and yet operates with a high mechanical efficiency, in the neighborhood of 95%. The mechanism is so compact that the crankcase which encloses it is itself quite small and may be pressurized without undue increase in weight and cost, thereby requiring piston rod seals that need seal against only engine cycle pressures, that is between the high and low pressure of the cycle, rather than the difference between engine high pressure and atmospheric pressure. It eliminates the complicated, expensive, and unreliable mean pressure control system of the prior art and all its control valves, check valves, high pressure gas lines, gas compressor, gas storage vessel, electronic controls and safety gear. The control linkage encounters no appreciable force and therefore a direct linkage to the control lever may be used for simplicity, low cost, and reliability. The response of the system is quite rapid, on the order of one half second between movement of the control lever and full movement of the hub 42.

The use of stroke control reduces the power piston speeds and hence reduces the piston rod seal wear and their frictional losses are further reduced because the mean pressure at shorter stroke and low power levels approaches the lower cyclic pressure. This is because the center stroke position of the piston at shorter stroke is shifted into the hot end, thereby effectively increasing the dead volume at the cold end. This "dead volume power control" is continuously variable, however, permitting continuous changes in power level as opposed to the discrete steps in power produced by the prior art devices. The lower mean engine working gas pressure also acts to reduce engine power, and the larger cool gas volume makes compression more isothermal, resulting in efficiency improvement that tends to offset the efficiency degradation that occurs as a result of the increased dead volume. The balancing wheel 152 completely balances the mechanism. However, the eye of the hub moves in a circular path at double the crankshaft speed, causing a second order vibration although it is less than 1°. The balancing wheel 152 also exerts a reaction force on the hydraulic cylinder 100 which reduces the thrust load on that mechanism exerted by the pistons through their piston rods 34. Although all control schemes for Stirling engines reduce engine efficiency somewhat from the optimum operating point, this mechanism introduces some countervailing advantages. The compression and expansion functions become more isothermal because of the lower flow rates, and the maximum and minimum temperatures in the heater and cooler will be closer to their extremes at low power levels for good efficiency due to the lower velocity of the gas in the heat exchangers.

Obviously, numerous modifications and variations of the disclosed embodiment will occur to those skilled in the art upon reading this disclosure. Accordingly, it is to be expressly understood that these modifications and variations, and their equivalents may be practiced while remaining within the spirit and scope of the invention as defined in the appended claims, wherein

I claim:

1. A mechanism for conversion between reciprocating motion of a reciprocating member and rotating motion of a rotating shaft, comprising:

a rotatable shaft having a straight portion disposed on an axis of rotation, and an offset portion whose axis extends at an angle to said axis of rotation;

a hub mounted on said shaft for rotation relative thereto and having one axial end portion axially slidably mounted on said offset portion, and the other axial end portion axially slidably mounted on said straight portion;

at least one arm mounted on said hub and extending radially therefrom, whereby said arm rocks in a reciprocating arcuate motion when said shaft rotates and said hub nutates relative to said rotating shaft; and means for controllably moving said hub axially relative to said shaft, thereby changing the angle of inclination of said hub relative to said shaft axis of rotation to control the stroke of said arm.

2. The mechanism defined in claim 1, wherein said hub includes:

an inner cylinder;

means slidably and non-rotatably mounting said inner cylinder on said shaft;

an outer cylinder rotatably mounted on said inner cylinder and non-rotatably connected to said reciprocating member.

3. The mechanism defined in claim 2, wherein said mounting means includes a pair of spherical bearings slidably mounted on said shaft for translation thereby, and tiltably mounting said inner cylinder on said shaft, whereby said inner cylinder swirls on said spherical bearings as said spherical bearings translate with respect to said shaft and thereby change the angle of inclination of said hub relative to said shaft axis of rotation.

4. The mechanism defined in claim 1, further comprising:

a cylindrical socket having an axis perpendicular to and intersecting said shaft rotation axis;

a pin having an axis perpendicular to said socket axis and said shaft rotation axis;

a cylindrical bore formed in said reciprocating member and rotatably receiving said socket;

whereby the small lateral and angular components of said arm reciprocating motion as said hub nutates on said shaft are accommodated by rotation of said socket about its axis in said bore, and by lateral movement of said socket in the direction of its axis in said bore.

5. The mechanism defined in claim 1, wherein said hub moving means includes:

a hydraulic cylinder;

a hydraulic piston mounted in said cylinder for movement relative thereto;

one of said cylinder and piston being connected to said shaft, and the other being connected to said hub; and means for controlling the introduction of hydraulic fluid under pressure from a space of pressurized hydraulic fluid, through a hydraulic fluid passage, and into said cylinder to cause relative translation between said cylinder and said piston and sliding translation of said hub relative to said shaft.

6. The mechanism defined in claim 5, wherein said hydraulic fluid introduction control includes:

an oil port in said other of said cylinder and piston, said oil port communicating between said hydraulic fluid passage and an oil sump;

a control spool slidably mounted on said other of said cylinder and piston;

means for moving said control spool;

whereby said control spool can be moved to a position blocking said oil port whereupon said hydraulic cylinder becomes pressurized with said hydraulic fluid and said hydraulic piston and cylinder more relatively until said oil port begins to clear said control spool and permit leakage of hydraulic fluid from said port at a rate at which the hydraulic fluid pressure force on said other of said cylinder and piston just matches the axial force between said reciprocating member and said arm, whereupon said hub inclination remains fixed.

7. The mechanism defined in claim 5, wherein said source of pressurized hydraulic fluid is a pump connected to said shaft.

8. The mechanism defined in claim 1, further comprising:

a balancing wheel mounted on and rotating with said shaft;

means connecting said balancing wheel and said hub to tilt said balancing sheet when said hub changes its inclination to maintain the dynamic balance of said shaft and its associated rotating structure of all angles of hub inclination.

9. The mechanism defined in claim 8, wherein said wheel is mounted on said shaft on a tilting axis perpendicular to said shaft rotation axis and laterally offset therefrom, said tilting axis being offset from the plane of said wheel through the center of gravity thereof, whereby tilting of said balancing wheel changes the distribution of the rotating mass of said wheel with respect to the shaft axis of rotation and with respect to the lateral mid-plane lying through said wheel tilting axis and perpendicular to said shaft axis of rotation, to enable the shaft to be balanced against mass eccentricities with respect to said shaft axis of rotation, and with respect to mass couples which would exert a torque on said shaft about a lateral axis.

10. A power control for a Stirling engine having an engine casing enclosing a plurality of working spaces, each containing a reciprocating piston which moves in its working space to cause working gas in said working space to circulate cyclically through a set of heat exchangers including a heater, a regenerator and a cooler to produce a pressure wave in said working space which produces reciprocating motion of a power output member and a mechanism for converting the reciprocating motion of said power output member to rotating motion of an output shaft, said power control comprising:

means for varying the stroke of said pistons to vary the volume of working gas circulated through said heat exchangers and thereby vary the power absorbed by said working gas from said heater to vary the output power to said power output member, said stroke varying means including an offset portion of said output shaft, a hub linked to said pistons and having a portion mounted on said offset portion for rotation relative thereto and for axial movement therealong, and means for selectively moving said hub along said shaft to vary the angle of inclination of said hub.

11. The power control defined in claim 10, wherein said engine is a double acting engine the pistons of which act both to circulate said working gas to produce said pressure wave, and reciprocate under the influence of said pressure wave to control said pressure wave to output power.

12. The power control defined in claim 11, wherein said pistons each include a piston rod attached at one end of said piston and attached at the other end of a crosshead, said hub being mounted on said shaft by two journal bearings, both of which can slide axially along said shaft.

13. A modified Stirling cycle machine, comprising:

a casing defining therein a plurality of working spaces each including an expansion space and a compression space;

means for charging a working gas into said working spaces;

means for transferring heat to said working gas;

means for transferring heat from said working gas;

a regenerator for removing heat from said working gas and then later returning the removed heat back to said working gas;

means for subjecting said working gas in each said working space to a modified Stirling cycle by heating and expanding said gas in said expansion space, transferring heat between said gas and said regenerator in one direction, cooling and compressing said gas in said compression space, and transferring heat between said gas and said regenerator in the other direction, said subjecting means including a reciprocating member movable in each working space on an expansion stroke wherein said working gas is heated and expands in said expansion space, and movable on a compression stroke wherein said working gas is cooled and compressed in said compression space;

a rotating power shaft for transmitting power between said machine and an external device;

a conversion mechanism for converting between the linear reciprocating motion of said reciprocating members and the rotating motion of said power shaft;

said conversion mechanism including an offset portion of said shaft disposed at an angle to the rotational axis of said shaft, a hub mounted on said offset portion for rotation and axial translation with respect thereto, and means for selectively moving said hub axially on said shaft;

said hub having a radially disposed arm connecting said hub and said reciprocating member;

whereby, reciprocating power to and from said reciprocating member is converted by said arm and said hub to and from rotating power of said shaft.

14. A Stirling engine comprising:

an engine casing defining therein a plurality of working spaces adapted to contain a working gas under high pressure, each working space including an expansion space and a compression space;

a heater for heating said working gas adjacent said expansion space;

a cooler for cooling said working gas adjacent said compression space;

a regenerator for removing heat from said working gas as it flows in one direction and for returning the removed heat back to said working gas as it flows in the other direction;

a linearly reciprocating piston movable in each working space in one direction on an expansion stroke wherein said working gas is heated and expands in said expansion space, and movable in the other direction on a compression stroke wherein said working gas is cooled and compressed in said compression space;

a power shaft mounted in said casing for rotation about its axis for transmitting rotating kinetic power from said engine to an external load;

a motion conversion mechanism mounted in said casing for converting the linear reciprocating motion of said reciprocating pistons to rotating motion of said power shaft;

said conversion mechanism including an eccentric portion of said shaft having an axial gradient of eccentricity to the rotational axis of said shaft, and a hub having a portion mounted on said eccentric portion for rotation relative thereto and for axial movement therealong and so that said hub nutates while said shaft rotates;

a set of radially extending arms connected to said hub and nutating therewith, said nutating arm motion having an axial stroke component;

means for selectively moving said hub axially along said shaft operative to change the tilt angle of said hub relative to said shaft axis to change the axial stroke component of said arm motion;

means for connecting one each of said arms to one each of said pistons, said connecting means forming a power transferring connection between the linear reciprocating motion of said piston and the nutating motion of said arm;

said connecting means having two portions, which slide radially relative to each other and which rotate relative to each other about two orthogonal axes;

whereby the radial and rotational movement of said arm as it nutates is accommodated by said connection means to permit a power coupling with a linear reciprocating piston.

15. The engine defined in claim 14, wherein said connecting means includes:

a crosshead attached to said piston and reciprocating axially therewith;

means in said crosshead defining therein a radially extending cylindrical bore;

a cylindrical socket radially slidable in said bore and rotatable about the axis of said socket;

a boss connected to the end of said arm remote from said shaft axis and received in said socket;

a pin extending transversely through said boss and into opposite sides of said socket to pin said boss to said socket for axial and radial translation therewith, and for rotation relative thereto about the axis of said pin.

16. The engine defined in claim 14, wherein said hub tilt angle changing means includes:

means slidably and rotatably mounting one end of said hub on said eccentric portion of said shaft;

means for slidably and rotatably mounting the other end of said hub on a straight axial portion of said shaft;

means for shifting the position of said hub axially along said shaft whereby said one end of said hub moves at an angle to said shaft axis while said other end moves axially, thereby causing said hub to tilt with respect to said shaft axis.

17. The engine defined in claim 16, wherein said position shifting means includes:

a hydraulic piston and a hydraulic cylinder connected, one to said shaft and the other to said hub, and defining a hydraulic chamber between said piston and said cylinder;

means for pressurizing said chamber with hydraulic fluid to cause relative movement between said piston and said cylinder, and thereby cause movement of said hub relative to said shaft.

18. The engine defined in claim 17 further comprising:

a valve having a valve member movable relative to said shaft for controlling the volume of hydraulic fluid in said hydraulic chamber and thereby control the degree of relative movement of said piston and said cylinder.

19. The engine defined in claim 18, wherein said valve comprises:

a hydraulic fluid port communicating between said hydraulic chamber and an oil sump;

a spool valve axially movable along said shaft between a fixed position covering said port and preventing escape of hydraulic fluid from said chamber, and a second position uncovering said port and allowing the escape of hydraulic fluid from said chamber.

20. The engine defined in claim 19, wherein said other of said piston and said cylinder includes an axially extending tubular section on which said spool valve is mounted and in which said hydraulic fluid port if formed, whereby the axial position of said spool valve can be set and said tubular section will move along said shaft under the influence of increasing or decreasing hydraulic pressure in said hydraulic chamber as said hydraulic fluid enters or escapes from said chamber, until said tubular section moves under said spool valve to the position at which said port is restricted to the extent that the hydraulic pressure in said chamber just balances the axial forces exerted on said hub by said pistons.

* * * * *